US006387307B1

(12) United States Patent
Bossetti

(10) Patent No.: US 6,387,307 B1
(45) Date of Patent: May 14, 2002

(54) METHOD FOR FEEDING A PRESSING APPARATUS

(75) Inventor: Renato Bossetti, Novara (IT)

(73) Assignee: S.I.T.I. S.p.A. Societa Impianti Termoelettrici Industriali (IT)

( * ) Notice: Subject to any disclaimer, the term of this patent is extended or adjusted under 35 U.S.C. 154(b) by 0 days.

(21) Appl. No.: 09/392,052

(22) Filed: Sep. 8, 1999

(30) Foreign Application Priority Data

Sep. 16, 1998 (IT) ..... MI98A2008

(51) Int. Cl.[7] ..... B28B 11/06; B28B 13/02
(52) U.S. Cl. ..... 264/113; 264/245; 425/447
(58) Field of Search ..... 425/447, 448, 425/227, 228, 229; 222/410; 264/112, 113, 245

(56) References Cited

U.S. PATENT DOCUMENTS 707,590 A * 8/1902 Holmes ..... 222/276
1,671,078 A * 5/1928 McManus ..... 425/324.1

FOREIGN PATENT DOCUMENTS

GB 2310161 A * 8/1997
JP 405154827 A * 6/1993

* cited by examiner

*Primary Examiner*—Nam Nguyen
*Assistant Examiner*—Joseph S Del Sole
(74) *Attorney, Agent, or Firm*—R. Neil Sudol; Henry Coleman; William Sapone

(57) ABSTRACT

The present invention relates to a method for feeding a granular or powderlike material to a pressing apparatus for the dry pressing of the material. The device comprises containers for the materials and rollers arranged at openings of the containers. Each roller has a cavity which is suitable to be filled by the material and to be freed of the material following a rotation of the rollers so as to pour the material into a mold. In the method, the rotation of the rollers is produced simultaneously with a movement of the rollers in a direction which lies at right angles to its axis. The invention allows to obtain particular color effects, such as colorings, color shades, basic decorations, complex decorations, natural stone-like effects, et cetera, on the resulting ceramic products, particularly tiles.

5 Claims, 9 Drawing Sheets

METHOD FOR FEEDING A PRESSING APPARATUS

BACKGROUND OF THE INVENTION

1. Field of the Invention

The invention relates to a device for feeding a pressing apparatus, to a pressing apparatus and to a pressing method.

More particularly, the field of the present invention relates to the dry pressing of ceramic material and even more particularly to the dry pressing of tiles.

In these pressing operations, the mold of the press must be filled with a ceramic material, in the form of granular or powderlike material, preferably of the so-called "atomized" type; then the upper surface of the mold, particularly for the pressing of tiles, is skimmed so as to obtain a flat surface of the material to be pressed; then the upper plunger is lowered and the material is dry-pressed. The formed material is then extracted from the mold and sent to the subsequent firing process.

2. Description of the Prior Art

According to the known art, the mold is loaded by means of a grille which can slide above and outside the mold. When the grille is outside the mold, it is loaded with the material to be pressed and is then made to slide above the mold, so that the material to be pressed fills the mold by gravity. Then, by means of the return motion of the grille, the material is skimmed on the surface of the mold.

This system generally has the problem of producing differences in the density of the material inside the mold, since the distribution of the powder in the grille depends on the movement of the grille above the mold and therefore the part of the mold that is skimmed last has a higher density than the rest. This uneven density gives rise to deformations during the firing of the part and therefore increases rejects.

This known method furthermore has problems when it is necessary to produce decorations having an aesthetic value on the tiles. The grille mixes the powder in its back-and-forth movement, accordingly limiting the aesthetic effects that can be obtained. Furthermore, in order to produce these decorations it is known to first load an atomized foundation of material and then, after a second pass, load a decorated surface layer. The decorated surface layer can be applied either by means of a second grille or by means of a retractable ribbon onto which the material has been loaded, in the required color composition, with a screen-printing screen. However, the use of a second grille still leaves the impressions of said grille in the final aesthetic result, producing an unwanted effect, whilst the retractable ribbon still entails a free fall of the material from the ribbon onto the mold, thus mixing the material and generating difficulties in obtaining decorations having the intended level of detail. The system is furthermore rather slow and this entails a reduction in the productivity of the plant.

Furthermore, during the return stroke for skimming the mold, a layer of powder of mixed colors is deposited over the decorated layer due to the inertia effects of the system; accordingly the finished tiles must be treated, after firing, in order to remove the surface layer, which is approximately 1 mm thick. This entails a long and expensive treatment which significantly affects the price of the end product.

Furthermore, the fact that the decorated layer is relatively thin with respect to the atomized foundation entails the fact that after tile laying the polishing of the floor by means of machines which use abrasives must be limited of necessity, in order to avoid fully removing the decorated surface layer.

It should also be noted that this system entails a high waste of ceramic powder, which accumulates below the carriage that moves the grille because the system requires an excess of powder by definition.

During the second loading operation using the colored material, said colored material is furthermore inevitably deposited only in the regions to be colored. This entails an accumulation of material and a higher density in the colored regions with respect to those that are not colored. These differences in density entail, during firing, deformations of the tiles, which are either rejected or must be subjected to grinding, entailing a significant cost increase.

Owing to the above cited problems it is impossible to obtain the decoration on the raw unpolished material, whereas the market, particularly the foreign market, requires to provide the decoration on the unpolished surface in order to improve antislip performance.

According to WO 98/23424, GB 2 310 161 and Patent Abstract of Japan vol. 017, no. 552 (M-1491). Oct. 5, 1993, JP 05 154827 it is known to use a roller provided with grooves to fill the grooves with a powder, so that a rotation of the roller causes the pouring of the powder on the article to be decorated. However this arrangement allows only a decoration of the surface of the article. It is impossible to have the full body of the article to contain the decoration. Again, the fact that the decorated layer is relatively thin with respect to the atomized foundation entails the fact that after tile laying the polishing of the floor by means of machines which use abrasives must be limited of necessity, in order to avoid fully removing the decorated surface layer. Also a single decorating material can be used. Also the relatively high thickness of the decorated parts cause density variations inside the tile, so that, during firing the tile is suitable to deform irregularly.

SUMMARY OF THE INVENTION

The aim of the present invention is therefore to overcome the above cited drawbacks with a device for feeding at least two different granular or powderlike materials to a pressing apparatus for the dry pressing of said materials, comprising at least two containers for said materials and at least two rollers arranged each at an opening of one of said containers; each of said rollers having a cavity which is suitable to be filled by one of said materials, by means of said opening, and being suitable to be freed of said material following a rotation of said roller so as to pour said material into a mold, so as to be able to generate colorings and/or shades and/or aesthetic effects as required.

The invention furthermore relates to a pressing apparatus which comprises a device as described above. For a description of a pressing apparatus which can be used with a device as described above, reference is made to European patent 0 422 041 in the name of the same Applicant.

According to another aspect, the invention furthermore relates to a method for the dry pressing of at least two distinct granular or powderlike materials, comprising the loading of a mold by virtue of the rotation of at least two rollers each one of which contains one of said materials in a cavity formed in itself; a first of said rollers loading certain parts of said mold; a second of said rollers loading other parts of said mold, that have been left free by said first roller; so as to generate colorings and/or shades as required.

Preferably, during the process the following operations are performed simultaneously:

a) a rotation of the roller and b) a relative movement of said rollers with respect to said mold, at right angles to the axis of said rollers;

so that the material is distributed in the mold as required.

BRIEF DESCRIPTION OF THE DRAWINGS

The invention will become apparent with reference to the drawings, given by way of nonlimitative example, of an embodiment of the invention, wherein.

DESCRIPTION OF THE PREFERRED EMBODIMENTS OF THE INVENTION

Figure 1:
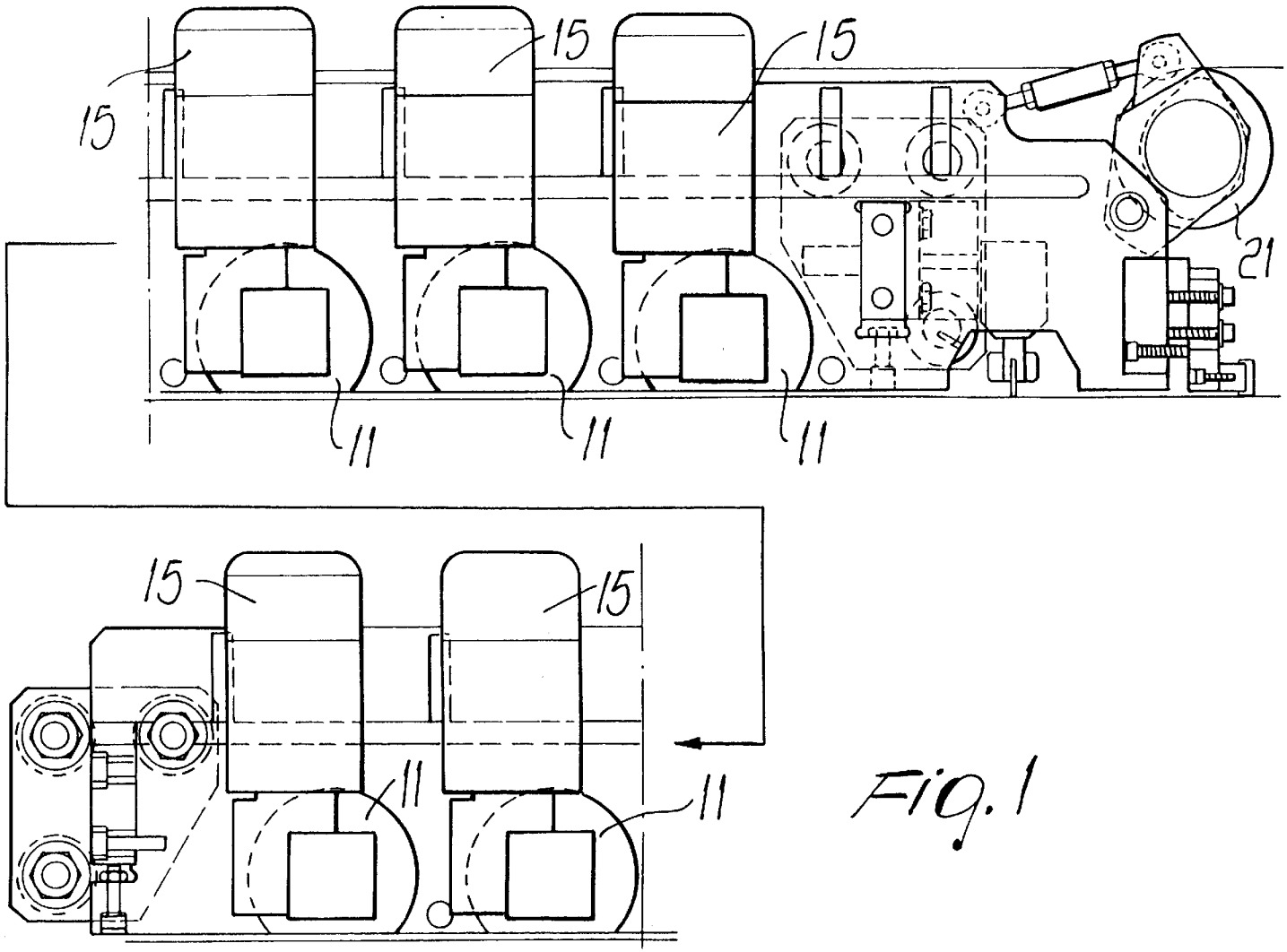
FIG. 1 is a side view of the device according to the invention.
Figure 2:
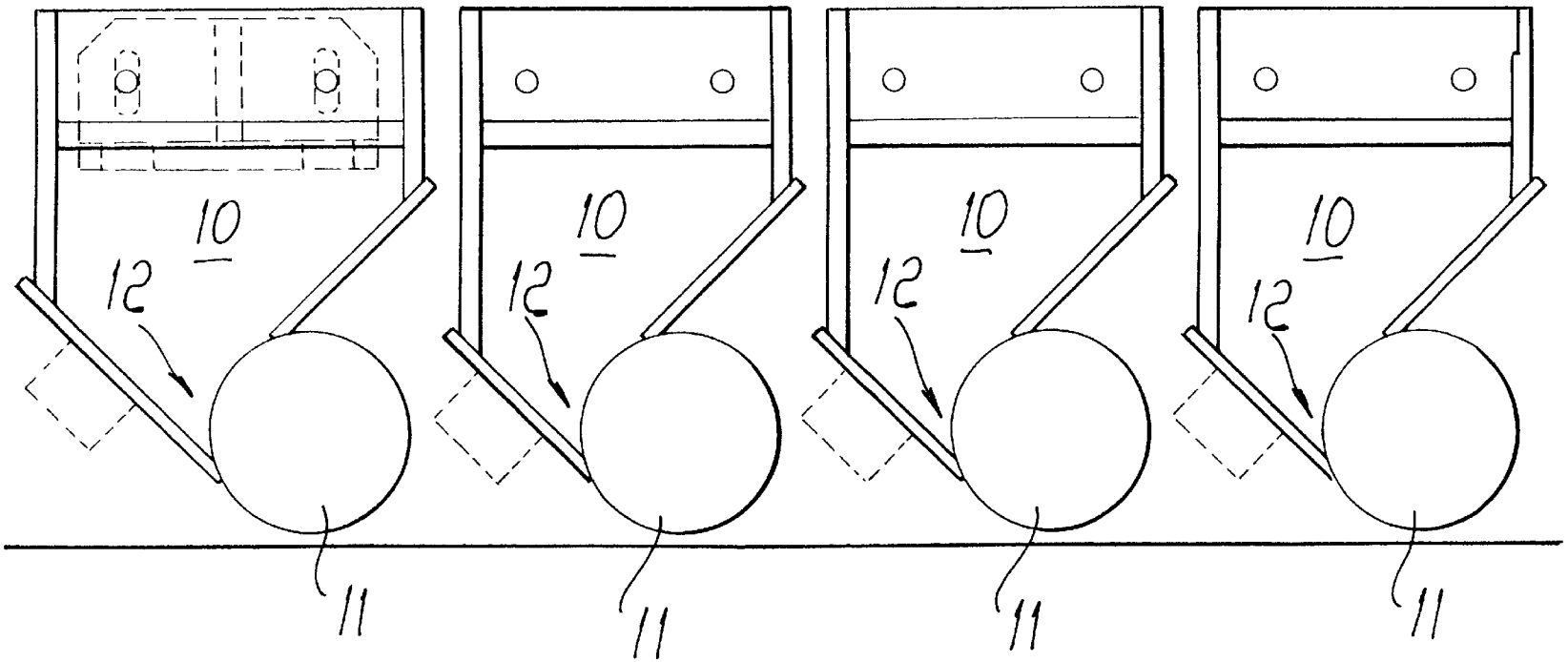
FIG. 2 is a sectional side view of the device of FIG. 1.
Figure 3:
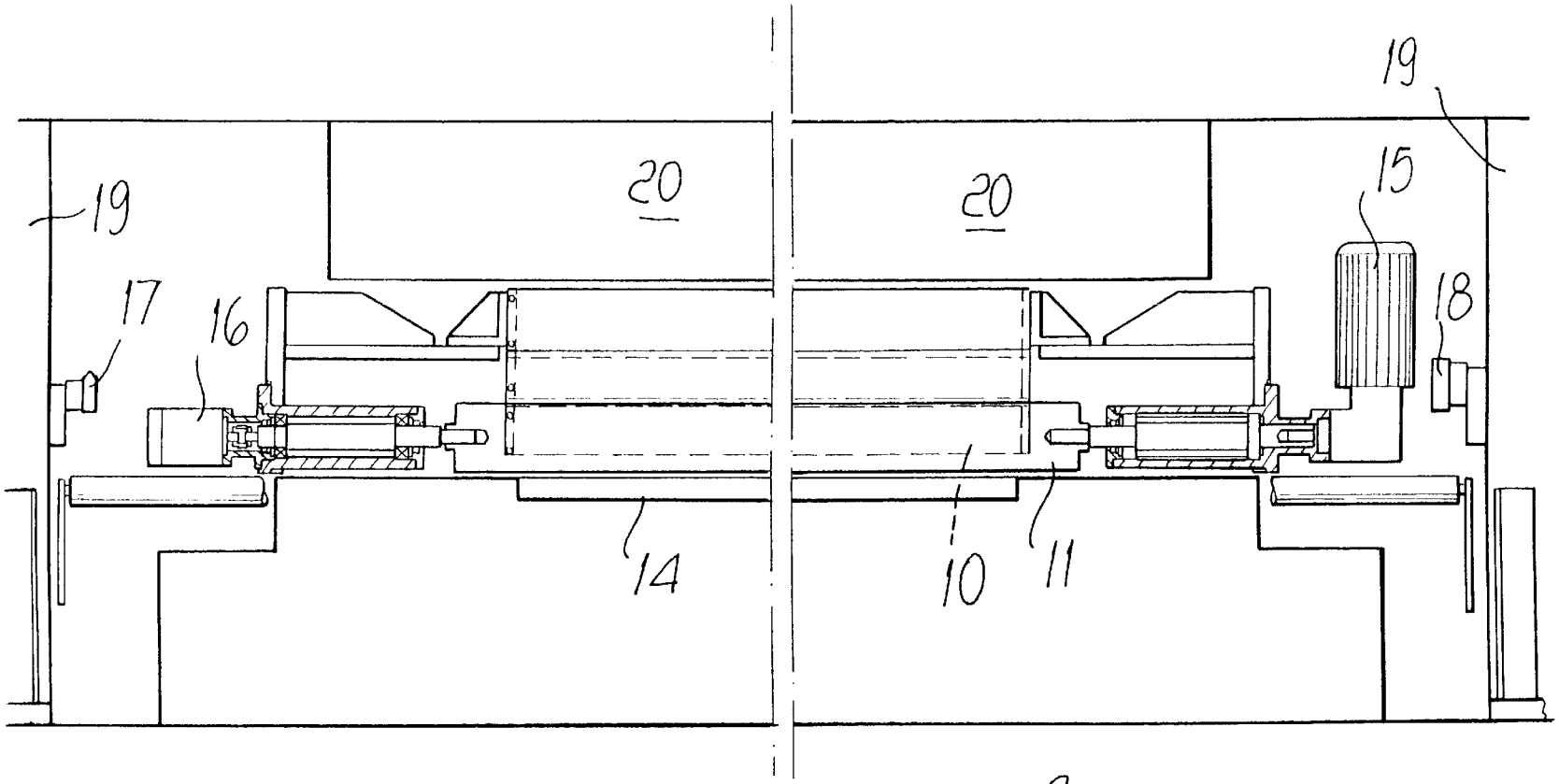
FIG. 3 is a partially sectional front view of the device according to the invention.
Figure 4:
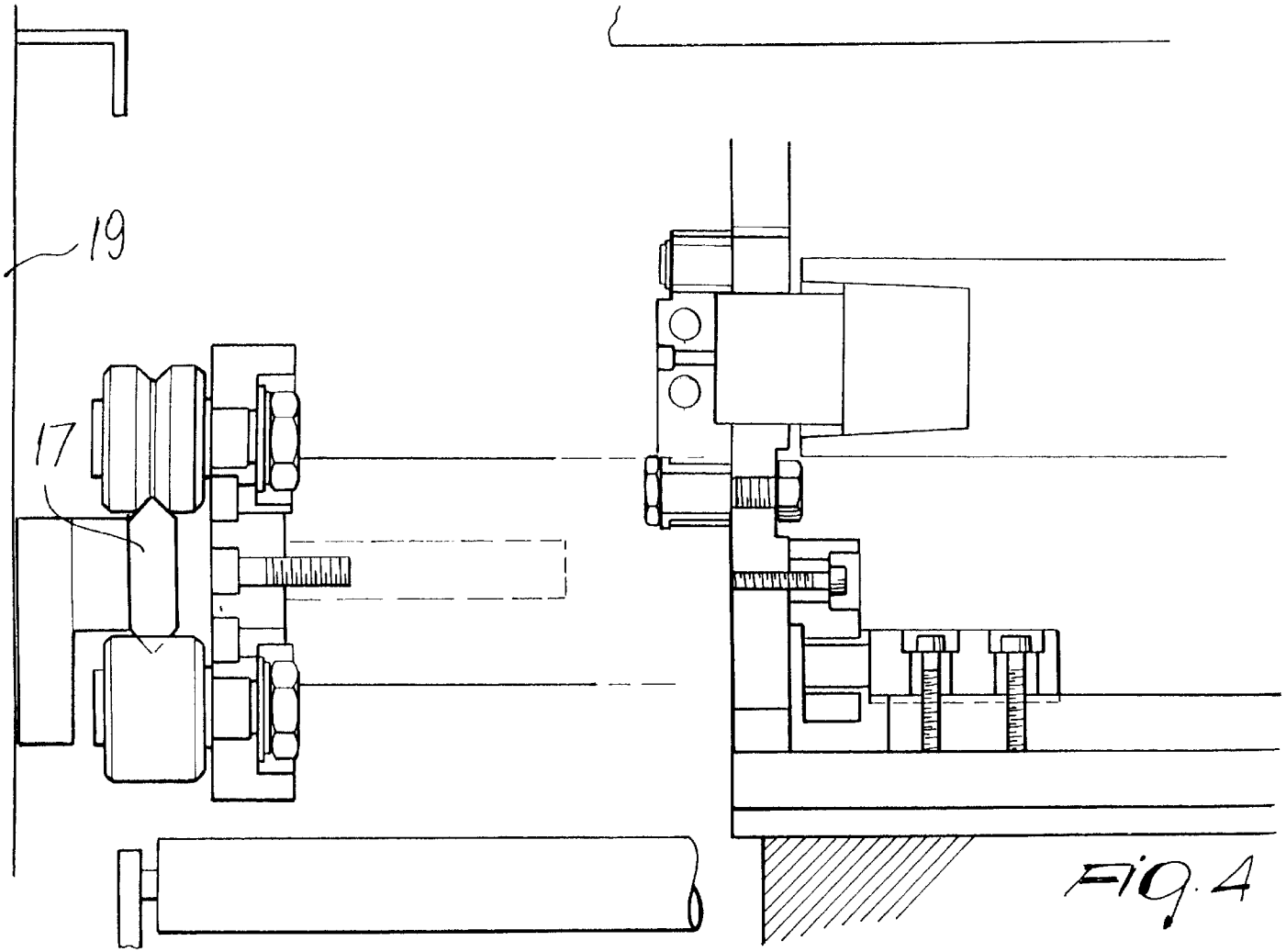
FIGS. 4 and 5 are views of details of FIG. 3.
Figure 5:
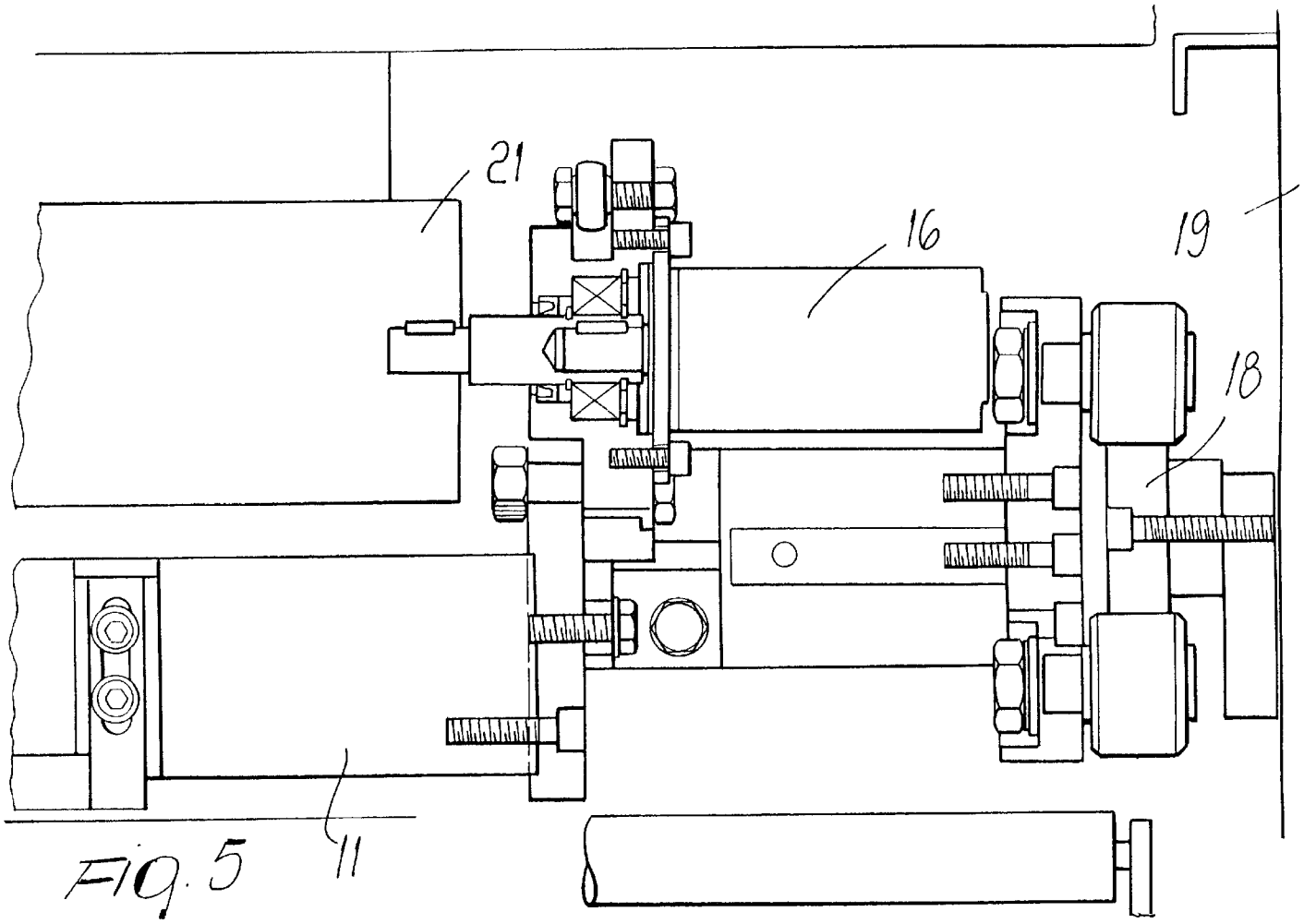
Figure 10:
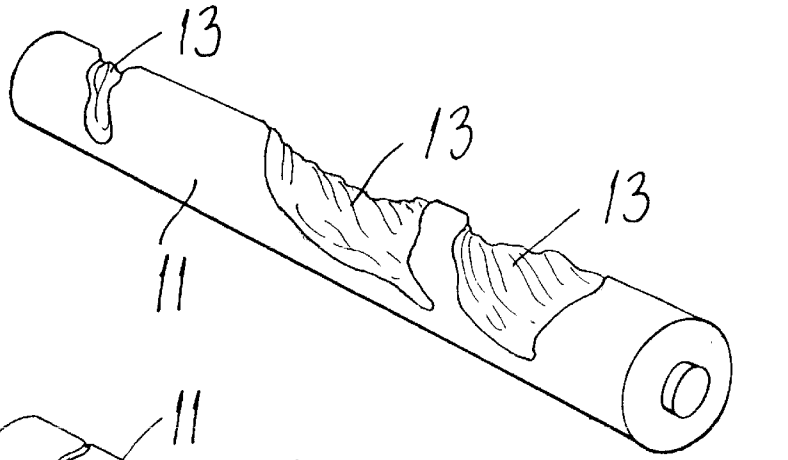
FIGS 9 and 10 are perspective views of the roller according to the invention.
Figure 9:
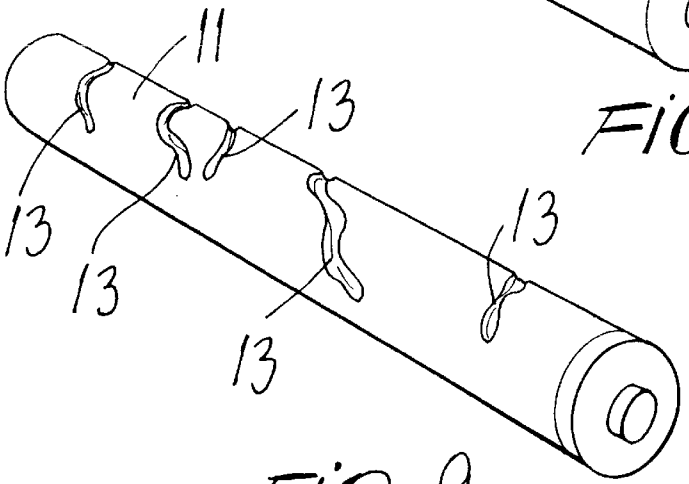

With reference to FIGS. 1 to 12, the device according to the invention comprises a plurality of containers 10, each one arranged for containing a distinct granular or powderlike material to be pressed, and a plurality of rollers 11 which are arranged each at an opening 12 of a container 10. The roller 11 has a cavity 13 which is suitable to be filled with the material to be pressed, which passes through the opening 12. The cavity 13 can be freed of the material to be pressed by virtue of a rotation of the roller 11 about its own axis. In this manner, the material to be pressed can be poured into a mold 14 which lies directly below the roller 11. The roller 11 is motorized by virtue of a servomotor which is constituted, for example, by a motor 15, than can be a step-motor or a motor controlled by an inverter and is feedback-controlled by virtue of an encoder 16.

The roller 11 can move above the mold 14 in a direction which lies at right angles to its axis. The container 10 can move together with the roller 11 and the entire assembly is supported by a movement unit which allows the roller 11 and the container 10 to slide above the mold 14. The movement unit comprises a pair of tracks 17 and 18 which are preferably fixed to a frame 19 of the pressing unit.

Figure 11:
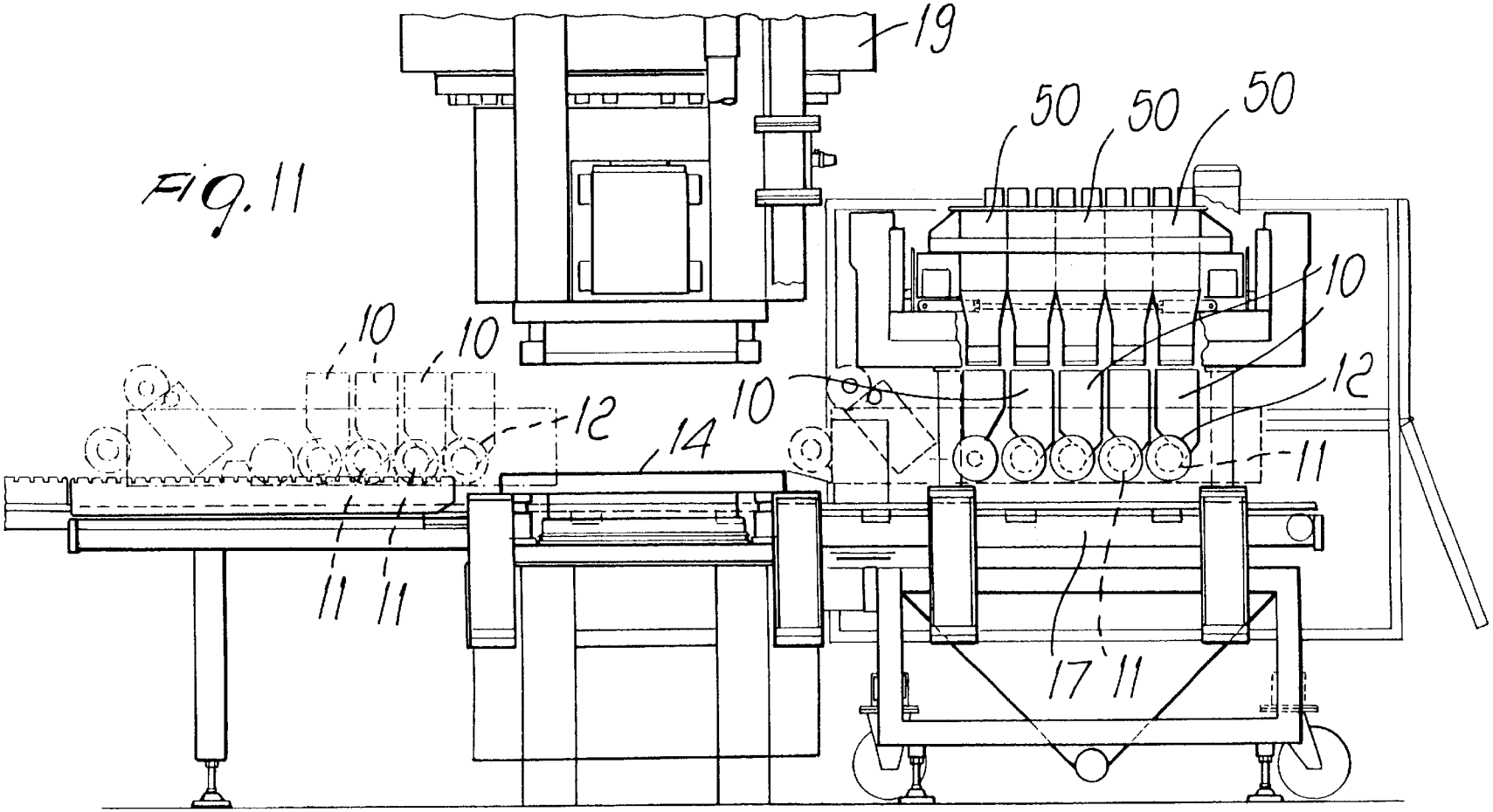
FIG. 11 is a sectional side view of a more detailed embodiment of the device of FIG. 1.
Figure 12:
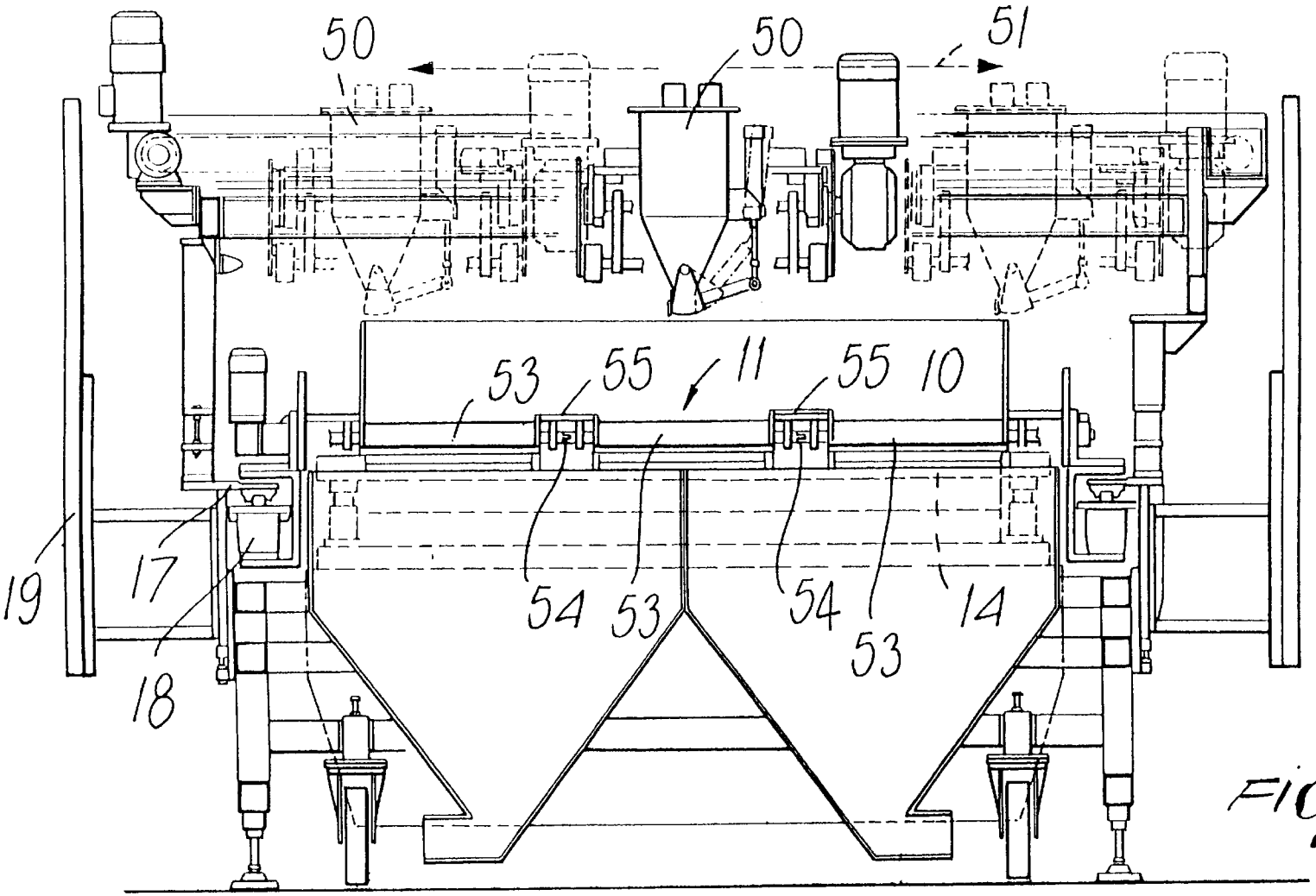
FIG. 12 is a partially sectional front view of the device of FIG. 11.

With particular reference to FIGS. 11 and 12, the containers 10 are fed by the feeding units 50. Each of the feeding units 50 can feed different powders and is movable horizontally, according to arrow 51 to fill all the length of the respective container 10. The feeding units 50 have a vertical movement for engaging and disengaging the containers 10.

Preferably, with particular reference to FIG. 12, each of the rollers 11 is divided into at least two partial rollers 53 having a single motorization; each partial roller is supported independently, by the supports 55. The shafts of the partial rollers 53 are connected by joints 54. This embodiment prevents the bending of long rollers and so prevents that some powder can pass through the opening (between the container 10 and roller 11) caused by such bending.

In the embodiment illustrated in the figures, the movement unit moves the assembly that supports the roller 11 and the container 10 directly in the space between the mold 14 and the upper punch 20, that is to say, directly in the pressing chamber. In this case, the movement unit also supports a brush 21 for cleaning the mold.

However, other embodiments are possible in which the movement unit that contains the roller 11 of the container 10 can move above a grille which is arranged outside the mold, so as to load the grille with the intended color patterns and then move the grille above the mold and load the mold directly by virtue of the grille.

As an alternative, it is also possible to move the mold outside the pressing chamber, perform loading externally and then move the movement unit above the mold but outside the pressing chamber, after which the mold loaded with the intended color composition can be returned into the pressing chamber to perform pressing. In this case it is also possible to move the mold with respect to the rollers 11, so that the axis of the rollers 11 are fixed and the mold 14 moves under the rollers 11.

According to the aim of the present invention, the loading of a mold 14 by means of the roller 11 need not be direct but may also occur by interposing a suitable means, such as for example a grille.

The invention achieves its advantages completely by utilizing a plurality of rollers 11, each of which has a respective container 10, an independent motorization means 15 and an independent encoder 16, so that each container 10 can be loaded with a material to be pressed which is different and therefore has a different coloring or different general characteristics, so as to allow to increase the possibilities of color decoration.

In practice, the motorization means 15 can be controlled by virtue of suitable software which allows to automatically transfer a pattern programmed on a computer to an actual decoration deposited in a mold.

The cavities 13 formed in the roller 11 can be different among the various rollers according to the particular decoration requirements to be met. In practice it has been found that it is possible to produce an enormous variety of colors and decorations, that is to say, vertical, diagonal and horizontal ones, imitating natural stone or forming invented textures, as required, thus allowing great possibilities of development for the creative skills of personnel assigned to decoration.

Figure 6:
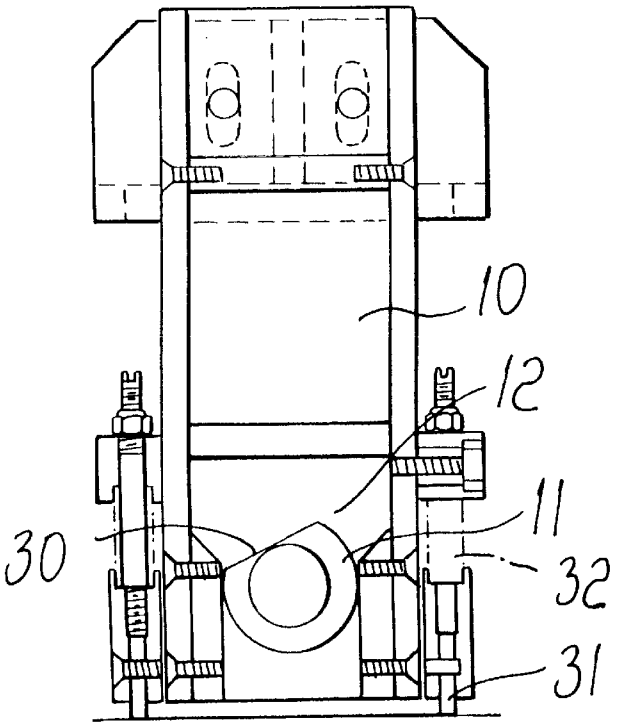
FIGS. 6, 7 and 8 are views of details of the side view of FIG. 1.
Figure 7:
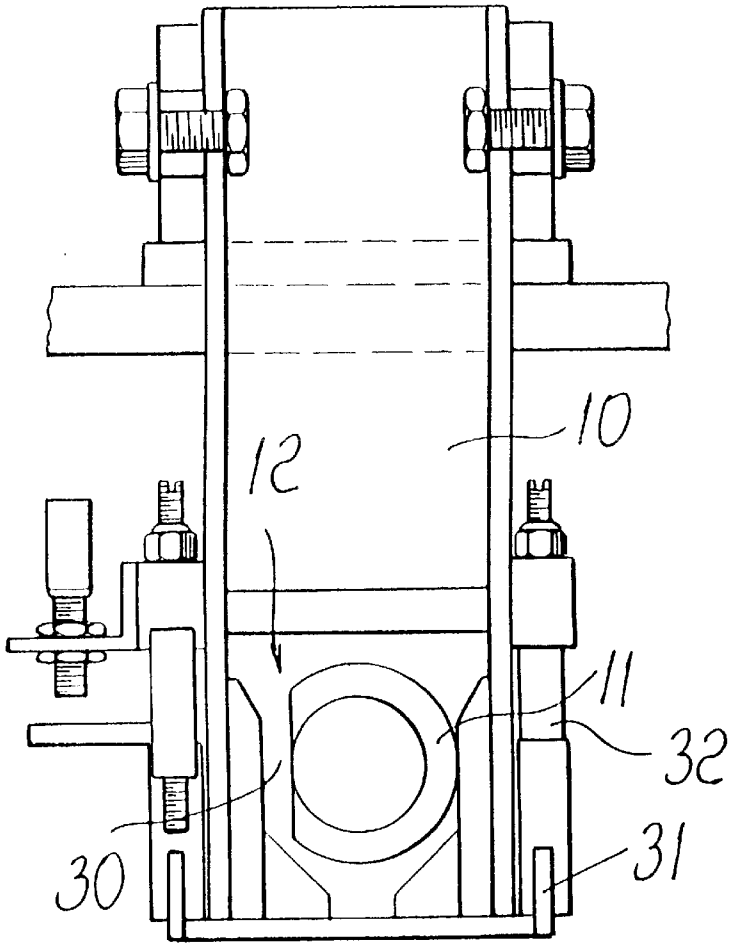

With particular reference to FIGS. 6 and 7, the last roller 11 has a cavity 30 which prevents the escape of material from the container 10, with particular reference to FIG. 6, or allows the escape of material, with particular reference to FIG. 7. The cavities 30 of the last roller 11 can be programmed so as to fill all the spaces that are still free in the pressing chamber 14, so that the complete filling of the mold 14 can be managed entirely by the software, without requiring a skimming operation. In practice, therefore, every point of the mold might be filled exactly with the required amount of material of the required color.

In any case, there is nonetheless a skimming means 31 which is actuated by the springs 32 in order to provide the assurance of skimming in case of programming errors. This skimming is in any case meant more to produce leveling than to provide skimming in the sense commonly used in the known art, since the system allows to avoid loading with an excess of powder.

Figure 8:
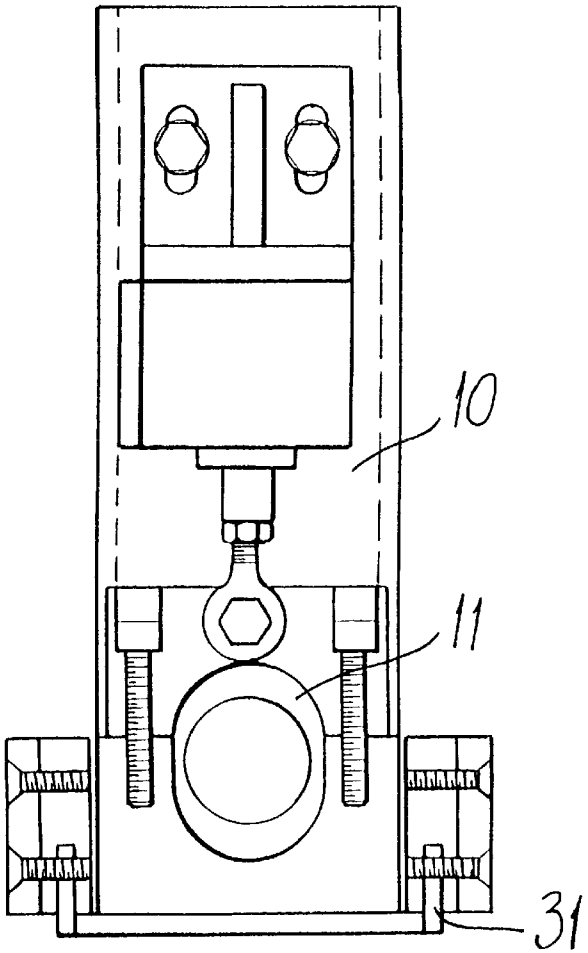

The means for lifting the skimming means 31 when the unit for moving the roller 11 and the container 10 moves the skimming means 31 away from the pressing plane is illustrated with particular reference to FIG. 8.

The motorization unit 15 and the control unit 16 allow to detect how much material a roller pours into the mold 14, so that it is possible to control which parts of the mold 14 have been let free of material by the first roller. So a second roller can be controlled, particularly determining it to fill just these free parts of the mold 14.

Of course, also the second roller can let some remaining free unfilled parts of the mold, that can be filled by a subsequent third or fourth roller 11. So all the mold can be filled by different rollers.

The invention allows to achieve the above described aim. In particular, it is possible, with only two rollers, to obtain decorations on the entire mix of the tile on porcelainized gres, and with multiple rollers, for example with four or five rollers 11, it is possible to obtain the most inventive decorations.

As an alternative, it is also possible, with the same apparatus and without having to perform modifications, to perform a double-mix loading in which the decoration is only superficial. According to another alternative, it is even possible to use the same apparatus to load a tile without decorations, such as for example a normal single-fired tile. It is also possible to produce a colored single-layer tile.

In practice, therefore, with the same apparatus it is possible to produce both conventional processes and, when necessary, decorations with different colorings and with extensive control options. This provide great flexibility, which is very important for an industrial plant of this type.

It has been found that the invention allows to avoid, when used to directly load the mold without interposing a grille, the mixing of the colors caused by the movement of the grille. In this manner, the deposition of a mixed surface layer during the return stroke of the grille is also avoided.

Less powder is wasted because by performing accurate software programming it is possible to load into the mold exactly the necessary amount of powder, without waste.

This powder calibration effect and therefore the possibility to perform only leveling but not an actual skimming allows to mold tiles having decorations directly on the upper layer without requiring surface grinding, thus allowing to achieve a saving in process costs and to meet the demands of markets which require antislip tiles.

Moreover, in this manner the density of the powder in the mold can be kept constant, thus avoiding deformations during firing and therefore avoiding the need to grind the tiles or decreasing the number of rejects.

The software-based control system that controls the step motors 15 and is controlled by the encoders 16 allows to separate the design phase from the production phase and to make the system for designing such decorations and modifying them when necessary faster, richer and more flexible.

Furthermore, the system according to the invention is faster than known systems, such as the one that uses a ribbon with a screen-printing screen. According to the invention, it is in fact possible to attain five or more beats per minute even when providing complex decorations on the tile.

The invention is susceptible to numerous modifications and variations, all of which are within the scope of the same inventive concept. Thus, for example, as mentioned, it is possible to load a grille meant to fill the mold whilst using the above described means or, as an alternative, it is possible to directly load a mold which is extracted from the pressing chamber.

Likewise, the movement, motorization and control means can be different without abandoning the scope of the same inventive concept.

What is claimed is:

1. A method for the dry pressing of at least two distinct granular or powderlike materials to form a manufactured product having a thickness dimension, comprising loading a mold by rotating at least two rollers each one of which contains one of said materials in a cavity formed in the respective one of said rollers, a first of said rollers loading certain parts of said mold, a second of said rollers loading other parts of said mold, that have been left free by said first roller, so as to generate a decorative pattern extending through the thickness dimension of the manufactured product.

2. A method according to claim 1 wherein the following actions are performed simultaneously:

(a) rotating of said rollers; and (b) relative moving of said rollers with respect to said mold, at right angles to axes of said rollers, so that said materials are distributed in said mold as required.

3. A method according to claim 2 wherein the rotating of said rollers and the relative moving of said rollers with respect to said mold include operating a computer operatively connected to said rollers and programmed to generate said decorative pattern of the manufactured product.

4. A method for the dry pressing of at least two distinct granular or powderlike materials to form a manufactured product having a thickness dimension, comprising:

loading a first one of said materials into a cavity provided in a first roller;

moving the loaded first roller relative to an empty mold;

during the moving of said loaded first roller relative to said mold, rotating the loaded first roller above said mold;

by virtue of the moving and rotating of the loaded first roller, depositing said first one of said materials in said mold in a first predetermined location therein, while leaving a portion of said mold empty of said first one of said materials;

loading a second one of said materials into a cavity provided in a second roller;

moving the loaded second roller relative to said mold partially filled with said first one of said materials;

during the moving of said loaded second roller relative to said mold, rotating the loaded second roller above said mold;

by virtue of the moving and rotating of the loaded second roller, depositing said second one of said materials in said mold in a second predetermined location therein different from said first location, thereby enabling generation of a decorative pattern extending through the thickness dimension of the manufactured product.

5. A method for feeding at least two different granular or powderlike materials to a pressing apparatus for the dry pressing of said materials, comprising:

filling cavities in at least two rollers with respective granular or powderlike materials from respective containers for said materials;

after the filling of said cavities, rotating the respective rollers to load the granular or powderlike materials in respective predetermined locations in a mold so that said materials extend from a lower side of said mold to an upper side thereof at the respective predetermined locations, the rotating of said rollers including operating at least one servomotor connected to said rollers and providing feedback to a controller from a plurality of encoders operatively linked to said rollers.

* * * * *